US005506372A

United States Patent [19]

Guth et al.

[11] Patent Number: 5,506,372

[45] Date of Patent: Apr. 9, 1996

[54] DEVELOPMENT STATION HAVING A PARTICLE REMOVING DEVICE

[75] Inventors: Joseph E. Guth, Holley; Eric C. Stelter, Rochester, both of N.Y.

[73] Assignee: Eastman Kodak Company, Rochester, N.Y.

[21] Appl. No.: 159,974

[22] Filed: Nov. 30, 1993

[51] Int. Cl.[6] ..... G03G 21/00

[52] U.S. Cl. ..... 118/652; 355/246; 355/251

[58] Field of Search ..... 355/259, 251, 355/253, 245, 246, 305–306, 203, 204, 208; 118/652, 657.8, 661, 653, 651, 656; 430/42

[56] References Cited

U.S. PATENT DOCUMENTS

| | | | |
|---|---|---|---|
| 4,470,694 | 9/1984 | Murakami et al. | 355/15 |
| 4,614,165 | 9/1986 | Folkins et al. | 118/657 |
| 4,647,186 | 3/1987 | Armstrong et al. . | |
| 4,733,267 | 3/1988 | Enoki et al. . | |
| 4,899,690 | 2/1990 | Hacknauer et al. | 118/653 |
| 5,095,850 | 3/1992 | Komuro | 118/657 |
| 5,138,382 | 8/1992 | Van Duser et al. | 355/215 |
| 5,138,388 | 8/1992 | Kamp et al. | 355/251 |
| 5,172,170 | 12/1992 | Hays et al. | 355/259 |
| 5,179,414 | 1/1993 | Bhagat | 355/259 |
| 5,184,194 | 2/1993 | Mosehauer et al. | 355/297 |
| 5,196,890 | 3/1993 | Nakayama et al. | 355/259 |
| 5,245,392 | 9/1993 | Behe et al. | 355/259 |
| 5,253,617 | 2/1994 | Benedict et al. | 355/253 |
| 5,270,782 | 12/1993 | Floyd, Jr. | 355/245 |
| 5,280,302 | 1/1994 | Rubin et al. | 346/762 |
| 5,357,317 | 10/1994 | Fukuchi et al. | 355/208 |
| 5,391,455 | 2/1995 | Bigelow | 430/120 |

*Primary Examiner*—A. T. Grimley
*Assistant Examiner*—Thu Dang
*Attorney, Agent, or Firm*—Leonard W. Treash, Jr.

[57] ABSTRACT

A development station for toning electrostatic images includes a particle removing device positioned adjacent an applicator. A variable bias is applicable to the particle removing device for periodically removing carrier from the applicator for disposal. Carrier is periodically added to the station during replenishment of toner. The particle removing device can also be biased to remove toner instead of or in addition to removing carrier to control conditions of excess toner concentration.

6 Claims, 3 Drawing Sheets

DEVELOPMENT STATION HAVING A PARTICLE REMOVING DEVICE

This invention relates to the development of electrostatic images using a two component developer.

U.S. Pat. No. 4,614,165, granted Sep. 30, 1986 to Fowlkins et al, is representative of a number of disclosures addressing the problem of the useful life of two component electrostatographic developers. Such two component developers include finely divided toner particles that are to be deposited on the electrostatic image and carrier particles which may be magnetic. The carrier particles triboelectrically charge the toner particles and also help transport them through a development station. The carrier particles remain in the station while the toner is used up in the toning process. After substantial use, the carrier particles lose their ability to impart the correct charge to the toner particles due to formation of a scum on the carrier particles from mixing with toner and other materials. They are replaced periodically by a serviceperson in most machines. The Fowlkins reference suggests replacing used toner by supplying to the developing station a mixture of 25% carrier and 75% toner particles by weight. This mixture is added periodically or on demand to a developer sump in the station that may be operating with a mixture of 95% carrier and 4% toner particles by weight. The added carrier particles cause the developer in the station to overflow into a separate container that can be emptied by the serviceman.

U.S. Pat. No. 4,899,690 to Hacknauer et al, Feb. 13, 1990, suggests a toner supply container that not only includes a small amount of carrier mixed with the toner but also has a compartment which is positioned to receive carrier overflowing the station as a result of the added carrier.

Carrier overflows, unfortunately, have a tendency to clog and have been difficult to design to work effectively. They require a predictable developer height at the overflow position.

It is generally known to scavenge carrier from a toned electrostatic image by various means which include a combination of magnetics and a constant electric field, as shown in U.S. Pat. Nos. 5,138,382 to Van Duser et al, Aug. 11, 1992, and 5,184,194 to Mosehauer et al, Feb. 2, 1993. It is also known to use a DC biased AC field to scavenge carrier from a toned electrostatic image, as shown in U.S. Pat. No. 4,647,186.

U.S. Pat. No. 5,138,388 to Kamp et al is typical of a number of references that show detoning rollers in magnetic brush cleaning apparatus. The detoning roller is biased to remove toner from a mixture of toner and carrier when the carrier is used in a cleaning environment.

U.S. Pat. No. 4,733,267 to Enoki et al, Mar. 22, 1988, shows a biased toner removing roller on a development brush which is said to make toner concentration more uniform on the brush.

Toner concentration in a two component mixture in a toning station can be controlled by use of a toner monitor or analysis of a toned patch on an image member. In either situation, but especially in the patch analysis approach, too much toner can be present in the toning station at times, resulting in thicker lines than desirable. A common remedy for this is to not add toner until the copy is acceptable. However, images in the meantime may be of inferior quality. Another approach is to run several high density images through the system to remove toner and then allow the system to make images to be used.

SUMMARY OF THE INVENTION

It is an object of the invention to provide a development station for toning electrostatic images which has an improved mechanism for removing particles from the development mixture.

This and other objects are accomplished by a development station which includes means for mixing and moving a mixture of toner and carrier through a path that passes through toning relation with an electrostatic image. The station includes a particle moving device having a movable removing surface and means for electrostatically and/or magnetically attracting toner and/or carrier from the mixture to the removing surface as the mixture moves through the path, and means for separating the toner and/or carrier from the removing surface for removal from the station.

According to a preferred embodiment, the particle removing device includes variable means for applying an electrical field associated with the removing surface and the path of the mixture, which field is variable from a condition in which particles are urged to the removing surface and a condition in which particles are not urged to the removing surface. This preferred embodiment permits the logic and control of the apparatus to remove carrier and/or toner selectively by adjusting the field. According to a preferred embodiment, carrier is removed according to a count of the number of copies made or the amount of toner added to the apparatus. According to another preferred embodiment, toner is removed in response to a signal from a patch or toner concentration sensing device that the toner concentration in the mixture is too high.

Since toner and carrier are charged oppositely in a two component system, a preferred embodiment includes a reversible power supply which would allow the removing device to remove selectively either carrier or toner, depending on the direction of the applied electric field. Generally, toner can be removed without removal of much carrier. Removal of carrier generally includes at least some removal of toner.

According to another preferred embodiment, a magnetic mechanism is provided to either remove carrier by itself or to assist the electrical bias to move carrier to the removing surface. Preferably, the magnetic device can be turned off either by interposing a movable shield, switching off an electromagnet, or moving the source of magnetism away from the mixture path to control particle removal.

Some or all of the preferred embodiments provide far superior control over removal of particles from a development station than is provided by prior apparatus and some of the embodiments perform the functions of removing either toner or carder as desired in the operation of the apparatus.

DESCRIPTION OF THE PREFERRED EMBODIMENTS

Figure 1:
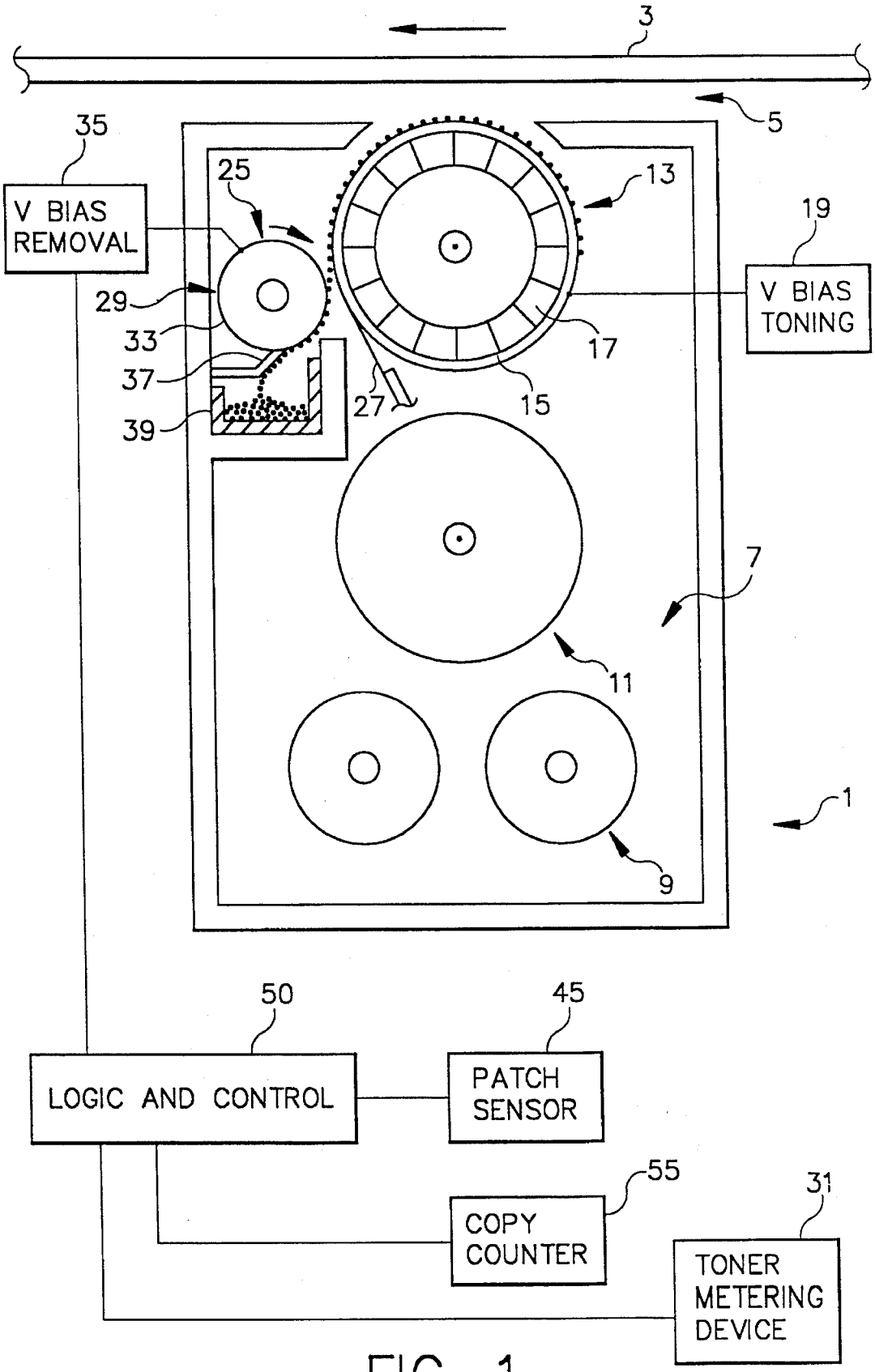
FIGS. 1, 2 and 3 are side schematics of alternative toning stations.

Referring to FIG. 1, a toning station 1 is positioned to apply toner to an electrostatic image carried on an image member, for example, a photoconductive belt 3, as the belt 3 moves through a development position 5. Toning station 1 is similar to known toning stations utilizing two component developer. Two component developer is a mixture of two oppositely charged particles generally called toner and carrier. The carrier is preferably of a material that can be moved magnetically, while the toner is oppositely charged from the carrier and is suitable for development of the image.

A development station includes a sump 7 having mixers 9 which mix the two component developer in the sump to make the relative concentrations of the particles uniform and provide a desired charge to the toner.

A feed roller 11 moves the developer mixture from the sump 7 to an applicator roller 13. The applicator roller moves the developer mixture through development position 5 either by the rotation of a sleeve 15, the rotation of a magnetic core 17 or both. If the magnetic core 17 is the primary moving device, the carrier should have a high coercivity for best results.

A variable power source 19 biases the toning roller 13 to create a field in the development position that controls development of the electrostatic image, as is well known in the art. The bias placed on the sleeve 15 by source 19 will sometimes be referred to herein as "V bias-toning".

As images are toned by station 1, the concentration of toner in the station is reduced and images are less dense. This condition can be sensed by a toner monitor associated with the station or by sensing the image or a patch associated with the image after toning. A toner supply includes a toner metering device 31 which feeds toner from the supply in response to a signal from a logic and control 50 that a patch sensor 45 or a toner concentration monitor, not shown, has indicated to the logic and control a need for a higher concentration of toner in the developer mixture.

To avoid the necessity of entirely replacing the carrier in the station when it is worn out, a small amount of carrier is added with the toner supply. This small amount exceeds the amount that is inadvertently carried away with the toner image on image member 3. Therefore, carrier is periodically removed from station 1. This is accomplished in FIG. 1 by a particle removing device 25 located close to the path of the developer mixture as the developer mixture leaves the development position 5 and before it has been skived from the sleeve 15 by a removal skive 27.

Particle removal device 25, as shown in FIG. 1, includes a removal roller 29 having a removal surface 33 which, on rotation of removal roller 29, comes into contact with or closely adjacent to the developer mixture. To remove carrier from station 1, a bias of opposite polarity to the charge on the carrier is applied to removal roller 29 by a variable power source 35. Variable power source 35 applies a bias, sometimes referred to herein as "V bias-removal", that creates a field between removal surface 33 and sleeve 15 that urges the carrier to removal surface 33. Further rotation of removal roller 29 brings whatever carrier has been attracted to surface 33 to a skive blade 37 which cleans surface 33, allowing carrier to fall into a removable holding container 39 where the serviceman can periodically remove the particles.

In operation, during toning, V bias toning applied by variable is power source 19 might be set at −100 V for charged area development using positive toner with a negative electrostatic image. V bias removal might be set by variable power source 35 at an appropriate level to inhibit attraction of either carrier or toner to it, for example, at −100 V or ground. To remove carrier, V bias-toning is set at ground while V bias-removal is set at +600 V to cause the negatively charged carrier to be attracted to the removal device.

In doing discharged area toning with a negatively charged image and negatively charged toner, toning is accomplished with both the V bias-toning and the V bias-removal at −500 V DC. Carrier removal is accomplished then by having V bias-removal at −600 V and V bias-toning at ground.

In each instance the change in biases is done for a short period of time, say, five seconds, during running of the apparatus periodically, say, every 100 copies, to remove a small amount of carrier into the holding container 39, which carrier is replaced along with the addition of toner.

In these examples, carrier removal is performed when V bias toning is set so that no image development is occurring, such as during the cycle up or cycle down periods of the electrophotographic process. However, it is also possible to remove carrier during image development by setting V bias removal a few hundred volts more positive or negative than V bias toning with the proper polarity to attract the carrier particles. If the electric force toward the removal device 25 is stronger than the magnetic force retaining the carrier particles on the applicator roller, carrier removal will occur.

This approach to removing carrier has the advantage of electrical control. If too much or too little carrier is being removed, only the period of time that the removal device is operative need be adjusted. It further has an advantage over devices that operate on an overflow principle of not requiring a station that has a predictable overflow level. Timing of the operation of particle removal device 25 to remove carrier can be keyed to a copy counter 55 or to toner metering device 31.

According to a preferred embodiment, the particle removal device 25 can also be used to remove toner from the system without removing carrier, merely by adjustment of bias. For example, to remove toner in the discharged area development example with negative toner, V bias-removal can be set at −100 V and V bias-toning at −510 V. This causes the toner to be attracted to removal surface 33 where it also is skived into holding container 39 by blade 37. In this instance, the carder is not attracted to surface 33, it being held by the magnetic force of magnetic core 17 and by the strong negative bias on sleeve 15. Thus, if patch sensor 45 indicates that the image is too dense, indicating too high a concentration of toner, a condition that can occur, for example, as a result of relative humidity changes, the logic and control 50 can control the biases to remove toner until the condition is corrected.

Figure 2:
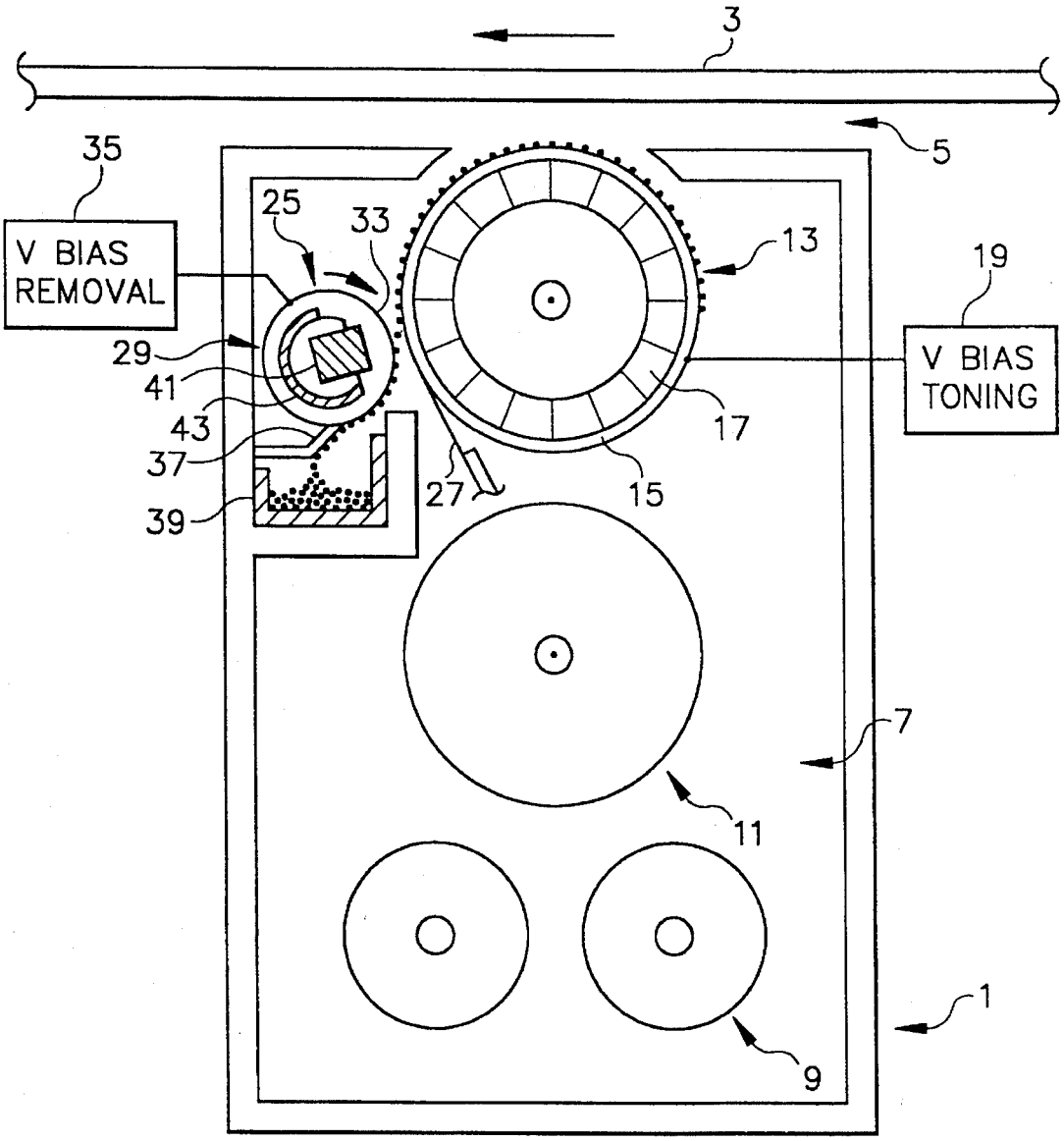

FIG. 2 shows an alternative embodiment essentially the same as FIG. 1 except that, in addition to the electrical field impressed with variable power source 35 on the removal surface 33, a magnet 41 also attracts carrier from sleeve 15. Magnet 41 can be of a magnitude that it essentially equalizes the force applied by magnetic core 17, allowing a much smaller V bias-removal for removal of carrier. Obviously, magnet 41 can be made large enough that it removes carrier by itself from sleeve 15. In such an embodiment, a shield 43 that is movable to a position blocking the magnetic force is employed to prevent the interruption of flow of developer when the station 1 is in a toning condition. The shield 43 is then moved to a removed condition, as shown in FIG. 2, during carrier removal. Such control of the magnetic field could also be effected by making magnet 43 an electromagnet or by allowing it to be rotatable to a removed position.

Figure 3:
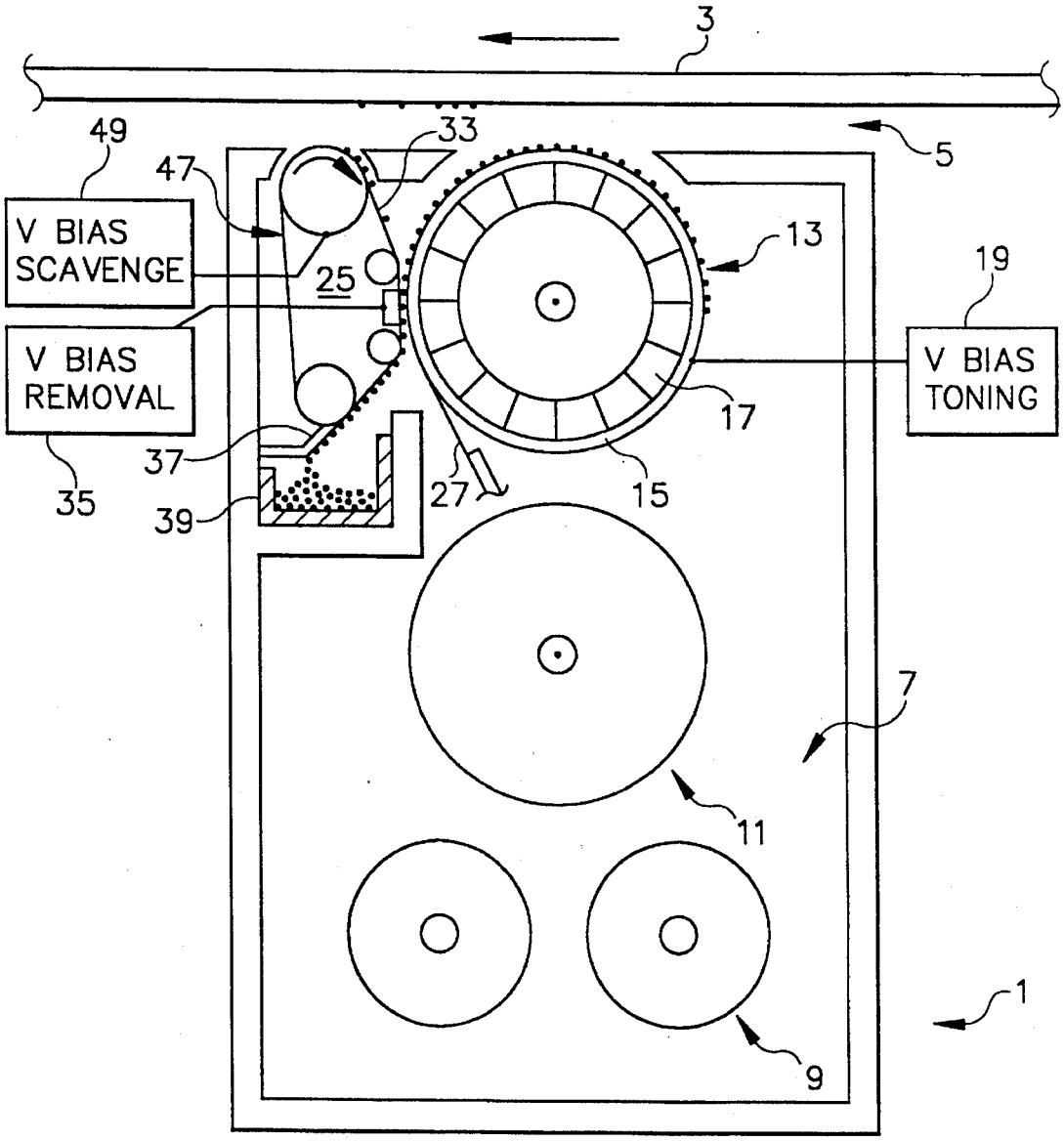

Referring to FIG. 3, removal roller 29 has been replaced by an endless removal belt 47 which adds an additional dimension to the apparatus. As removal surface 33 moves adjacent the developer mixture path, it is backed by an electrode connected to variable power source 35 for application of the V bias-removal, as in FIGS. 1 and 2. However, the path of the belt has an upper extension which brings it relatively close to image member 3 and allows it to operate also as a scavenger. Thus, another power source 49, applies a bias, sometimes referred to herein as "V bias-scavenge", to a roller backing the belt in the region of image member 3. During toning, V bias-scavenge is placed at a level tending to attract carrier but not toner, for example, with negatively charged toner and positively charged carrier, V bias-scavenge could be at −600 V. In addition, a medium frequency AC signal could also be imposed on the V bias-scavenge to help loosen carrier on image member 3.

Although the removal roller 29 or belt 47 can be independently driven by its own motor, it can also be geared to other moving portions of the station, for example, the feed roller 11, mixers 9 or sleeve 15.

The invention has been described in detail with particular reference to a preferred embodiment thereof, but it will be understood that variations and modifications can be effected within the spirit and scope of the invention as described hereinabove and as defined in the appended claims.

We claim:

1. A development station for toning electrostatic images, said station comprising:

means for mixing and moving a mixture of charged toner and oppositely charged carrier through a path that passes through toning relation with the electrostatic image, a particle removing device having a movable removing surface and means for electrostatically attracting carrier from the mixture to the removing surface as the mixture moves through the path, a logic and control, which logic and control includes means for controlling applying of a removal bias to the removing surface attractive to carrier, which logic and control includes means for periodically switching between a first position in which said bias is applied to remove a small amount of carrier from the mixture and a second condition in which the bias is not applied and no carrier is removed, and means for separating carrier from the removing surface for removal from the station.

2. A development station according to claim 1 including a skive blade positioned to engage the removing surface at a skive position to separate particles therefrom, said skive being positioned over a removable container positioned to receive particles which fall under force of gravity from the skive position.

3. A development station according to claim 1 further including an applicator positioned in a developing relation with an electrostatic image to be toned, means for driving the developer mixture around the applicator through the development position and wherein the removal device is positioned opposite the applicator, downstream from the development position with respect to the movement of the mixture.

4. A development station according to claim 1 wherein said logic and control includes means for adjusting the bias on the removal device to change the removal device to apply the removal bias periodically in relation to use of the development station.

5. A development station for toning electrostatic images, said station comprising:

means for mixing and moving a mixture of charged toner and oppositely charged carrier through a path that passes through toning relation with the electrostatic image, a particle removing device having a movable removing surface and means for electrostatically attracting toner or carrier from the mixture to the removing surface as the mixture moves through the path, a particle removing device having a first condition in which a bias of a first polarity is applied to it to remove carrier and a second condition in which a bias of a second polarity opposite the first polarity is applied to it to remove toner, and means for separating toner or carrier from the removing surface for removal from the station.

6. A development station for toning electrostatic images, said station comprising:

means for mixing and moving a mixture of charged toner and oppositely charged carrier through a path that passes through toning relation with the electrostatic image, a particle removing device having a movable removing surface and means for electrostatically attracting toner from the mixture to the removing surface as the mixture moves through the path, a logic and control which includes means for adjusting the bias on the removal device according to a sensed indication of toner concentration in the mixture, and means for separating toner from the removing surface for removal from the station.

* * * * *